US006213741B1

(12) United States Patent
Mori et al.

(10) Patent No.: US 6,213,741 B1
(45) Date of Patent: Apr. 10, 2001

(54) SCROLL TYPE COMPRESSOR

(75) Inventors: Tatsushi Mori; Shinya Yamamoto; Hiroyuki Hayashi; Shigeru Hisanaga; Yukio Ogawa; Tsuyoshi Takemoto, all of Aichi-ken (JP)

(73) Assignees: Kabushiki Kaisha Toyoda Jidoshokki Seisakusho; Denso Corporation, both of Kariya (JP)

( * ) Notice: Subject to any disclaimer, the term of this patent is extended or adjusted under 35 U.S.C. 154(b) by 0 days.

(21) Appl. No.: 09/153,371

(22) Filed: Sep. 15, 1998

(30) Foreign Application Priority Data

Sep. 16, 1997 (JP) ..... 9-250381

(51) Int. Cl.[7] ..... F03C 2/00
(52) U.S. Cl. ..... 418/55.2
(58) Field of Search ..... 418/55.2

(56) References Cited

U.S. PATENT DOCUMENTS

| | | | | |
|---|---|---|---|---|
| 5,520,525 | | 5/1996 | Mizuno et al. | 418/55.2 |

FOREIGN PATENT DOCUMENTS

| | | | | |
|---|---|---|---|---|
| 0 318 189 | | 5/1989 | (EP) . | |
| 318189 | * | 5/1989 | (EP) | 418/55.2 |
| 0 761 971 | | 3/1997 | (EP) . | |
| 3164589 | | 7/1991 | (JP) . | |
| 404054202 | * | 2/1992 | (JP) | 418/55.2 |
| 406101665 | * | 4/1994 | (JP) | 418/55.2 |
| 7299631 | | 11/1995 | (JP) . | |

OTHER PUBLICATIONS

Patent Abstracts of Japan, vol. 010, No. 051 (M–457) Feb. 28, 1986 & JP 60 201092 A (Mitsubishi Denki KK), Oct. 11, 1985.

Patent Abstracts of Japan, vol. 010, No. 286 (M–521), Sep. 27, 1986 & JP 61 104183 A (Mitsubishi Electric Corp), May 22, 1986.

Patent Abstracts of Japan, vol. 095, No. 007, Aug. 31, 1995 & JP 07 109980 A (Nippondenso Co Ltd; Others: 01), Apr. 25, 1995.

European Search Report.

* cited by examiner

*Primary Examiner*—Thomas Denion
*Assistant Examiner*—Theresa Trieu
(74) *Attorney, Agent, or Firm*—Morgan & Finnegan, L.L.P.

(57) ABSTRACT

A performance of a compressor is enhanced and durability of scroll bodies is enhanced by optimizing relief to machining tolerance at a central end part of spiral members for forming the scroll bodies. In a scroll type compressor in which a reinforced portion (for example, a large radius of curvature R) reinforced more than in other root corner portions 5 is provided in a root corner portion 5 at a central end part in which a stress of the two spiral members 10 and 20 is increased, a first relief is formed in a region in which the two spiral members 10 and 20 come into contact with each other where the reinforced portion is applied only to one of the spiral members 10 and 20, and a second relief larger than the first relief is provided in a region in which the two spiral members come into contact with each other at a portion in which the radius of curvature R is provided in both of the two spiral members, thereby reasonably forming reliefs for avoiding interference at the point of contact of two spiral members.

9 Claims, 7 Drawing Sheets

SCROLL TYPE COMPRESSOR

BACKGROUND OF THE INVENTION

The present invention relates to a scroll type compressor used in an automotive air-conditioner or the like, and more particularly to the shape of scroll body for the purpose of enhancing the performance of the compressor and durability of the scroll body.

As shown in FIG. 6, in general, a conventional scroll body for a scroll type compressor is composed of a stationary scroll body 1 and a movable scroll body 2. Both of the stationary scroll body 1 and the movable scroll body 2 are each composed of a substantially disc-shaped plate member (not shown) and a spiral member 10, 20 formed on one surface of the plate member. The stationary scroll body 1 and the movable scroll body 2 are combined with each other so that their spiral members 10 and 20 are engaged with each other. Then, when the movable scroll body 2 is moved in a circular orbital motion while coming into contact with the stationary scroll body 1 a pair of compression chambers 31 and 32 are formed between the two scroll bodies 1 and 2. Also, the compression chambers 31 and 32 move toward the center of the spiral members 10 and 20. In accordance with this movement, the volume of the compression chambers 31 and 32 is decreased so that any coolant gas therein is compressed.

It is possible to apply a variety of involutes as a curved line for defining the spiral members 10 and 20. However, an involute of a circle that is easy to handle is generally used. However, since a large amount of stress is applied to an initial winding part (i.e., the central end part of the spiral member), in order to increase the mechanical strength of this part, the wall thickness of the spiral members is increased and at the same time, this part is formed into a round shape to avoid sharp edges. For this reason, the point where the involute changes is determined at a suitable involute angular position. The outer end part side of the involute change point is formed into an involute curved line, and the central end part side of the involute change point is formed into another curved line.

Also, the scroll bodies 1 and 2 are generally made of a cast material such as aluminum alloy, and thereafter, finished by machining such as cutting. The inner wall and the outer wall of the spiral members 10 and 20 are conventionally end-milled. In order to further enhance the mechanical strength of the central end part of the conventional scroll bodies 1 and 2 that is subjected to particularly large stress, a cutting tool of an end mill which is different from the tool for the other portions is used for the central end part. As shown in FIG. 8, a radius of curvature R larger than other portions is formed at a root corner end part 5 where the wall surface meets the plate member so as to be more reinforced than other root corner end parts.

For this reason, the machining precision of the wall surface of the central end part is not as good as at the other parts of the scroll bodies. Accordingly, with respect to this central end part, the two spiral members interfere with each other due to machining tolerances, and there is a fear that excessive wear or contact force may occur. Therefore, a relief is formed in order to avoid this interference. For this relief, a cutaway portion 4 is also formed in the inner wall of the central end part as shown in FIG. 7.

FIG. 9 shows a state where the spiral member 20 of the second scroll body (for example, the movable scroll body) 2 is arranged at an interval corresponding to a radius of the revolution relative to the spiral member 10 of the first scroll body (for example, the stationary scroll body) 1.

In FIG. 9, an angular region A1 between a point a1 and a point b1 on the wall surface of the spiral member 10 and an angular region A2 between a point a2 and a point b2 on the wall surface of the spiral member 20 indicate the portions of the spiral members 10 and 20 in which stress is increased. A radius of curvature R larger than that of the other parts is applied to each root corner portion 5 (see FIG. 8) as described above.

In FIG. 9, points a21 and b21 at which normal lines L11 and L12 from the points a1 and b1 of the spiral member 10 intersect with the spiral member 20 are theoretically the points of the associated member with which the points a1 and b1, respectively, come into contact when the scroll bodies 1 and 2 are operated. In the same manner, points a11 and b11 at which normal lines L21 and L22 from the points a2 and b2 of the spiral member 20 intersect with the spiral member 10 are theoretically the points of the associated member with which the points a2 and b2, respectively, come into contact when the scroll bodies 1 and 2 are operated. Thus, in FIG. 9, when a normal line is drawn from any desired point of the inner wall of one of the spiral members, the point on the inner wall of the associated member at which the normal line intersects represents a point at which the two members contact with each other.

However, in the above-described angular regions A1 and A2, since the radius of curvature R larger than that for the other portion is applied to the root corner portion as described above, machining precision is reduced. Accordingly, in region D including the two regions A1 and A2, as indicated by the dotted line in FIG. 9 (or as shown in the perspective view of FIG. 7), the cutaway portion 4 to be used as the relief is provided on the inner wall of the spiral member 20 of the second scroll body 2. Here, in order to facilitate the understanding of the cutaway portion 4 in the drawings of FIG. 7 and FIG. 9, the size thereof is exaggerated.

FIG. 8 is a cross-sectional view of the spiral member 10 of the first scroll body 1 which has been cut away up to the dotted line in FIG. 9. The wall thickness of this part of the spiral member 20 is cut away up to the dotted line so that the wall is thinner than the theoretical shape. The machining tolerance based on reduced machining precision is dealt with by this cutaway portion 4.

In the above-described conventional compressor, the state of contact between the two spiral members 10 and 20 is categorized into three types, i.e., a region in which the portions having the radius of curvature R larger than that of the other portions, as the portion reinforced more than the other root corner portions, namely, the above-described portions in which machining precision are not good, appear in both the spiral members, a region in which the portions appear in one of the spiral members, and a region in which the portions do not appear in any of the spiral members. In FIG. 9, the region B is the region in which the portions that are machined with less precision having the radius of curvature R appear in both the spiral members. In this case, the machining tolerances of both spiral members 10 and 20 are combined to cause such portions with less precision. Also, the regions C1 and C2 are regions in which the portions that are machined with less precision having the radius of curvature R appear in either one of the spiral members 10 and 20. In this case, errors caused by the machining tolerances of one of the spiral members appear. However, the cutaway portion 4 serving as the relief is formed with a constant relief dimension in the region D including these regions B, C1 and C2. For this reason, in the regions C1 and C2 where only one of the machining tolerances appear, the relief action would be excessive, so that the gap between the two spiral members is large. As a result, the performance of the compressor would be degraded. Also, there is a tendency for the durability of the spiral members to become worse due to the extra cutaway portions.

SUMMARY OF THE INVENTION

In view of the foregoing defects inherent in conventional techniques, the present invention has been made, and therefore, an object of the present invention is to enhance the performance of a compressor and the durability of scroll bodies by optimizing the relief to machining tolerances at a central end part of spiral members for forming the scroll bodies.

In order to attain this and other objects, according to a first aspect of the present invention, the two spiral members engaged with each other are characterized in that a root corner portion reinforced more than any other root corner portions is formed at a central end part of both of the spiral members where large stress is generated, and in that in regions where both of said spiral members contact with each other, a first relief is provided where said reinforced portion is present in only one of said spiral members and a second relief larger than said first relief is provided where said reinforced portion is present in both of said spiral members.

In this case, "relief" means a relief portion provided on one of the spiral members or both of the spiral members in order to avoid any interference of the two spiral members at the contact point due to machining tolerances caused by providing the root corner portion that is more reinforced than the other root corner portions, at the central end part where the stress is increased.

With such an arrangement, it is possible to avoid the excessive relief of the conventional systems. As minimum and reasonable relief as possible is formed between the two spiral members so that the performance of the compressor may be enhanced. Also, since excessive cutaway is avoided in the spiral members, it is possible to enhance their durability.

The above-described first and second reliefs may be formed in any desired manner in both the spiral members or in just one of the spiral members. As in the second aspect of the present invention, however, if respective reliefs are formed of the cutaways formed on both the spiral members, the cutaway amount is reduced in each spiral member. As a result, the durability of the spiral members is further enhanced. However, if each relief is thus formed of a cutaway portion provided on each spiral member, the involutes of the spiral members will be changed in three steps, resulting in a complicated shape and complicated machining. Accordingly, as in a third aspect of the invention, if the first relief is formed in one of the spiral members and the second relief is formed in the other spiral member, the cutaways are dispersed between both spiral members so that their durability is enhanced, and at the same time, the involute of each spiral member changes by only two steps so that machining is facilitate.

Also, as in a fourth aspect of the present invention, if the first and second reliefs are formed of cutaways formed in only one of the spiral members, since the involutes of the spiral members do not change in a stepped manner, which is the most easy to machine.

Also, as in a fifth aspect of the present invention, if the ends of the cutaways for defining the first and second reliefs are connected to each other with smooth lines, it is possible to eliminate the stress concentration at the end part edges of the cutaways to thereby enhance the durability of the spiral members.

DESCRIPTION OF THE PREFERRED EMBODIMENTS

Figure 1:
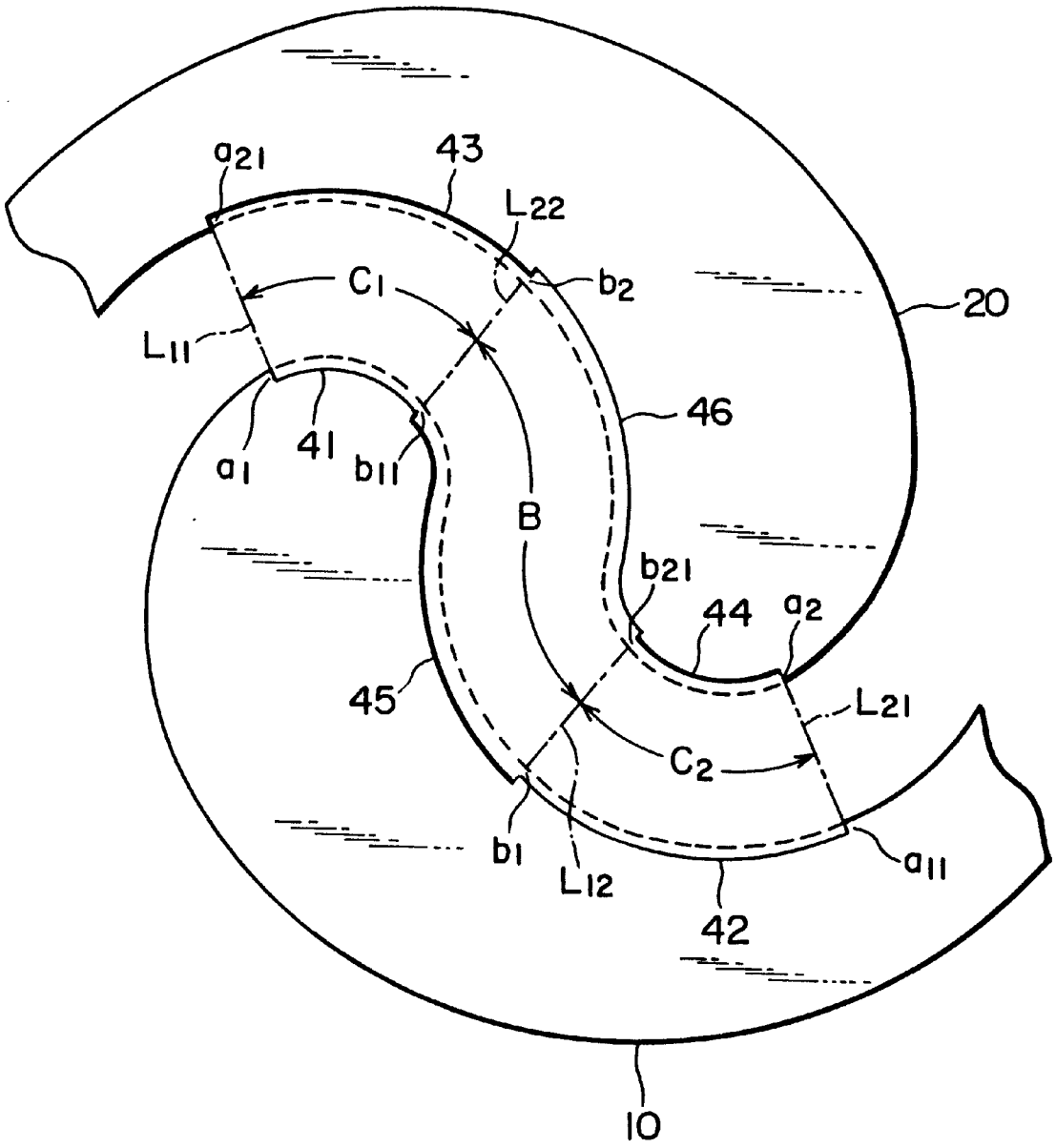
FIG. 1 is a structural schematic view showing a central end part of spiral members according to a first embodiment of the present invention.

Embodiments of the present invention will now be described with reference to FIGS. 1 to 5. Here, since a scroll type compressor in accordance with the present invention is the same as a general scroll type compressor except for the shape of the two scroll bodies, the main explanation will be made as to the shape of the spiral members according to the present invention. Also, in the following explanation in conjunction with the drawings, the same reference numerals as those of the above-described conventional scroll bodies are used to indicate the like portions or components and their explanation will be omitted.

A basic concept of the present invention that is common with the respective embodiments will be described before explanation of the respective embodiments.

First of all, in the same manner as in the conventional general compressor, in a central end part of each of the spiral members 10 and 20 of the scroll bodies, a radius of curvature R larger than that of other root corner portions is formed in a root corner portion 5 in which the stress to be applied to each spiral member is increased in comparison with the other portions in order to form a portion more reinforced than the other portions.

Next, when the wall surface of the portion 5 is end-milled, a cutting tool that is different from the tool for the other portions is used for the portion 5, so it is currently inevitable that the portion is machined with less precision. In order to avoid any interference of the two spiral members 10 and 20 with each other due to machining error, a relief is formed in the conventional manner, for the purpose of absorbing the machining tolerances. Accordingly, the provision of the relief per se is the same as that of the conventional system.

However the present invention is characterized in how the relief is provided.

In the conventional system, as described above, a relief having a constant dimension is formed for regions C1 and C2 in which the portion where the radius of curvature R is formed reducing the machining precision is provided in only one of the spiral members that come into contact with each other and for the region B in which the portion of the radius of curvature R is formed in both the spiral members. However, in all of the following embodiments, the two regions C1 and C2 and the region B are separated and suitable dimensions are set for the relief.

Namely, in each of the following embodiments, a first relief having a small enough dimension absorb machining tolerances of one of the spiral members 10 and 20 is formed in the regions C1 and C2 in which the portion where the radius of curvature R is applied to thereby reduce the machining precision appears in only one of the spiral members 10 and 20 that come into contact with each other, and a large second relief (twice as large than the first relief) having such a dimension that the machining tolerances of both the spiral members 10 and 20 may be absorbed is formed in the region B in which the portion where the radius of curvature R is applied to thereby reduce the machining precision appears in both the spiral members 10 and 20 that come into contact with each other. Thus, an excessive large relief may be avoided in the first relief.

Also, such first and second reliefs are formed by cutaways provided in one of, or both of the spiral members 10 and 20. There is a difference in how to make the cutaway portions between each of the embodiments. However, in any of the embodiments, a larger radius of curvature R is formed in a root corner portion 5 of each of the spiral members 10 and 20, thereby enhancing their durability. At the same time, the first and second reliefs are formed into ones having suitable dimensions, thereby enhancing the performance of the compressor.

The following explanation will be made mainly as to the characterizing features of each embodiment in conjunction with the accompanying drawings. Further, in each of the drawings, the cutaway portions 41 to 44, 51, 52, 61, 62, 71, 72, 81 and 82 for composing the first reliefs and cutaway portions 45, 46, 53, 63, 73, 74 and 83 for composing the second reliefs are exaggerated in respect to their actual sizes for the purpose of facilitating understanding of those constructions in the drawings.

FIG. 1 shows a first embodiment of the present invention in which the above-described first and second reliefs are formed in the spiral members 10 and 20, respectively.

In FIG. 1, stress is increased in the regions of points a1 to b1 and points a2 to b2 in a central end part of each of the spiral members 10 and 20 in the same manner as in the conventional system. In a root corner portion of this part, a radius of curvature R larger than that of the other parts is formed in the same manner as in the conventional system. This is also the case in the following embodiments.

Also, according to this and the following embodiment of the present invention, the first relief is formed in the regions C1 and C2, and the second relief is formed in the region B.

Further, in this embodiment, cutaway portions 41, 42, 43 and 44 in which the cutaway amount is small are formed between points a1 and b11 of the inner wall and between points b1 and a11 of the inner wall of the spiral member 10, and between points a21 and b2 and between points b21 and a2 of the inner wall of the spiral member 20. These cutaway portions 41, 42, 43 and 44 define the first reliefs.

Also, cutaway portions 45 and 46 in which the cutaway amount is large are formed between the points b11 and b1 of the inner wall of the spiral member 10 and between the points b2 and b21 of the inner wall of the spiral member 20. These cutaway portions 45 and 46 define the second reliefs.

The scroll bodies having the spiral members 10 and 20 in accordance with the above-described embodiment are made of cast aluminum alloy and are manufactured by cutting or the like. The inner walls of the spiral members 10 and 20, the root corner portions of the inner walls, and the cutaway portions 41 to 46 of the inner walls and the outer walls are simultaneously cut by end-mill machining. A different cutting tool is used for cutting portions other than these portions.

In the cutaway portions 41 to 46, when machining tolerances are disregarded, the involutes may be represented by the dotted lines in FIG. 1. Accordingly, the difference between the dotted lines and the solid lines amount to be cutaway.

The amount of the portions to be cut away may be set so that the sum of the cutaway amounts of the corresponding cutaway portions is substantially the same as the value of the machining tolerance. In this embodiment, the cutaway amounts of the cutaway portions 41 and 42 provided on the side of the spiral member 10 are the same as that of the cutaway portions 43 and 44 provided on the side of the spiral member 20, and the cutaway amount of cutaway 45 provided on the side of the spiral member 10 is the same as that of the cutaway 46 provided on the side of the spiral member 20. However, the cutaway amount for both the spiral members 10 and 20 may be distributed in any desired manner. It is to be understood that the distribution is not particularly limited to that shown in this embodiment. Also, since the machining tolerance for the region B is about twice as large than that for the regions C1 and C2, the cutaway amounts for the cutaway portions 41 to 44 in the first relief is about half the cutaway amount for the cutaway portions 45 and 46 in the second relief.

In this embodiment, in the regions C1 and C2, the two spiral members 10 and 20 perform a circular orbital operation in close proximity to or in contact with each other through the first relief, whereas in the region B, the two spiral members perform a circular orbital operation in close proximity to or in contact with each other through the second relief. Accordingly, there is no wasteful relief in the regions C1 and C2, and only the required minimum relief is formed corresponding to the machining tolerances. Therefore, the performance of the compressor is enhanced. Also, since the cutaways are dispersed in the two spiral members, the respective cutaway amounts are reduced in both the spiral members. Accordingly, reductions of the wall thickness of the spiral members are minimized and the durability of the spiral members 10 and 20 is enhanced.

Further, with respect to the two spiral members 10 and 20, since the involutes must be changed in a stepped manner for the cutaways 41 to 44 defining the first relief, and for the cutaways 45 and 46 defining the second relief, the manufacture therefor would be troublesome in comparison with the second embodiment to be described next.

Figure 2:
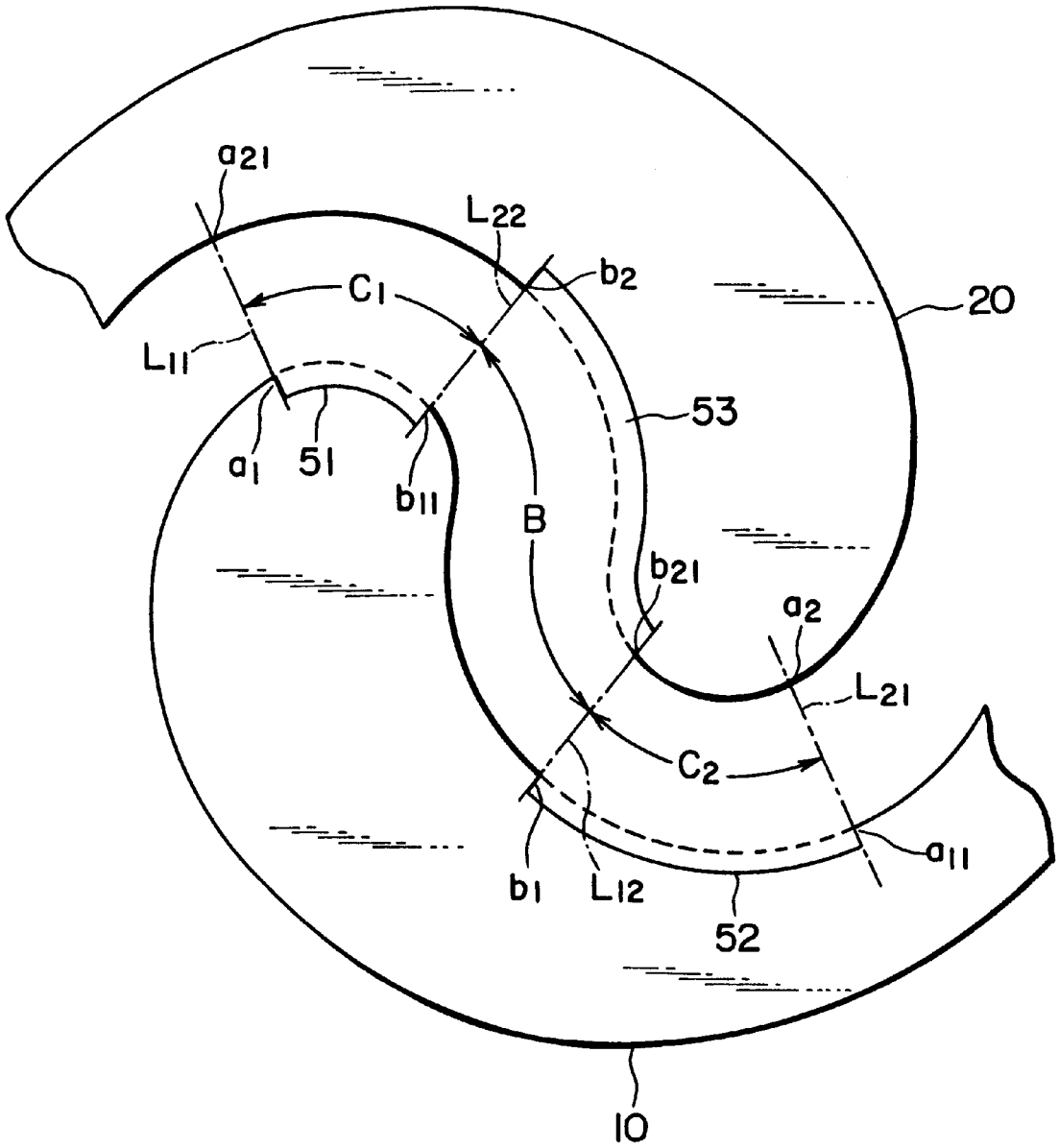
FIG. 2 is a structural schematic view showing a central end part of spiral members according to a second embodiment of the present invention.

FIG. 2 shows the second embodiment that differs in how to make the cutaways for the first and second reliefs. In FIG. 2, the first relief is composed of a cutaway portion 51 formed between the points a1 and b11 on the wall of the spiral member 10 and a cutaway portion 52 formed between the points b1 and a11 on the wall of the spiral member 10 but no machining work is effected on the spiral member 20.

Further, the cutaway amount for each of the cutaway portions 51 and 52 is the dimension obtained by adding up the cutaway amounts of each of the cutaway portions 41 and 43 (or the dimension obtained by adding the amounts of each of the above-described cutaway portions 42 and 44).

On the other hand, the second relief is composed of a cutaway portion 53 formed between the points b2 and b21 on the wall of the spiral member 20 but no machining work is effected on the spiral member 10. Further, the cutaway amount of this cutaway portion 53 is a dimension obtained by adding the amounts for the above-described cutaway portions 45 and 46.

In the case of the second embodiment, as cutaways having the same cutaway amount for each spiral member may be provided, in comparison with the first embodiment, changes in the involutes for defining each of the spiral members may be reduced, making easy to manufacture the spiral members.

Further, it is also possible to reverse the portions to which the cutaways are applied by providing them symmetrically opposite in the other spiral member, respectively. Namely, it is possible to form the cutaway portions 51 and 52 for defining the first reliefs between the points a21 and b2 on the inner wall and the points b21 and a2 on the inner wall on the side of the spiral member 20 and the cutaway portion 53 for defining the second relief between the points b11 and b1 on the inner wall on the side of the spiral member 10 to obtain the same effect as described above.

Figure 3:
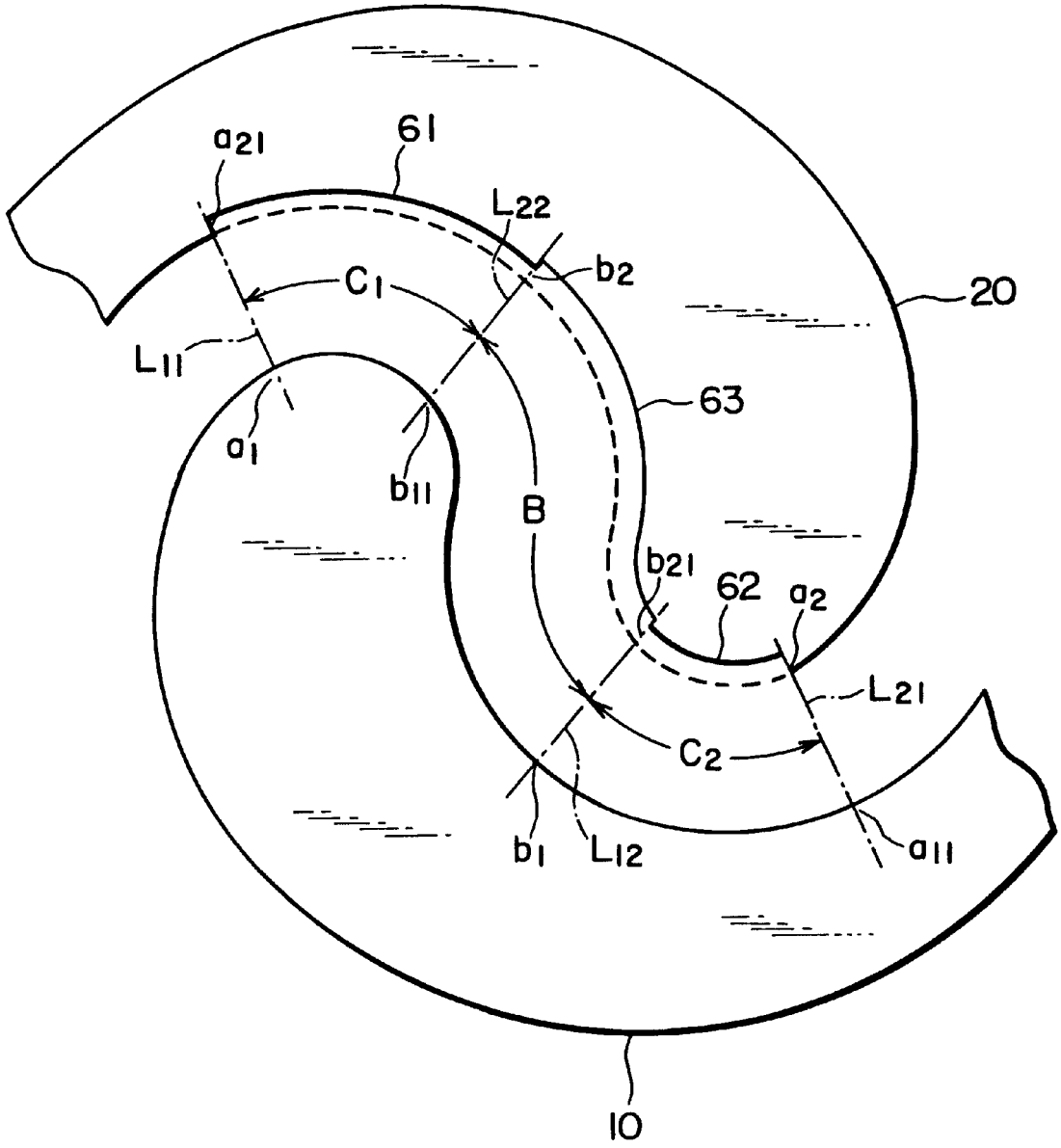
FIG. 3 is a structural schematic view showing a central end part of spiral members according to a third embodiment of the present invention.

FIG. 3 shows a third embodiment in which the cutaway portions for defining the reliefs are formed only on the side of the spiral member 20. Namely, the cutaway portions 61 and 62 for defining the first relief are formed between the points a21 and b2 on the inner wall and between the points b21 and a2 on the inner wall of the spiral member 20. Also, the cutaway amount of the cutaway portions 61 and 62 is the same as that of the cutaway portions 51 and 52 of the above-described second embodiment.

The cutaway portion 63 for defining the second relief is formed between the points b2 and b21 on the inner wall of the spiral member 20. The cutaway amount of the cutaway portion 63 is the same as that of the cutaway portion 53 of the above-described second embodiment.

In this embodiment, the cutaway portions 61, 62 and 63 are formed only in the spiral member 20. It is unnecessary to provide any cutaway in the other spiral member 10 at all. The formation of the involute on the spiral member 10 is simplified to facilitate the manufacture of the spiral members.

Further, even if the cutaways are not formed in the spiral member 20 but made symmetrically opposite in the spiral member 10, it is possible to ensure the same effect as described above.

Figure 4:
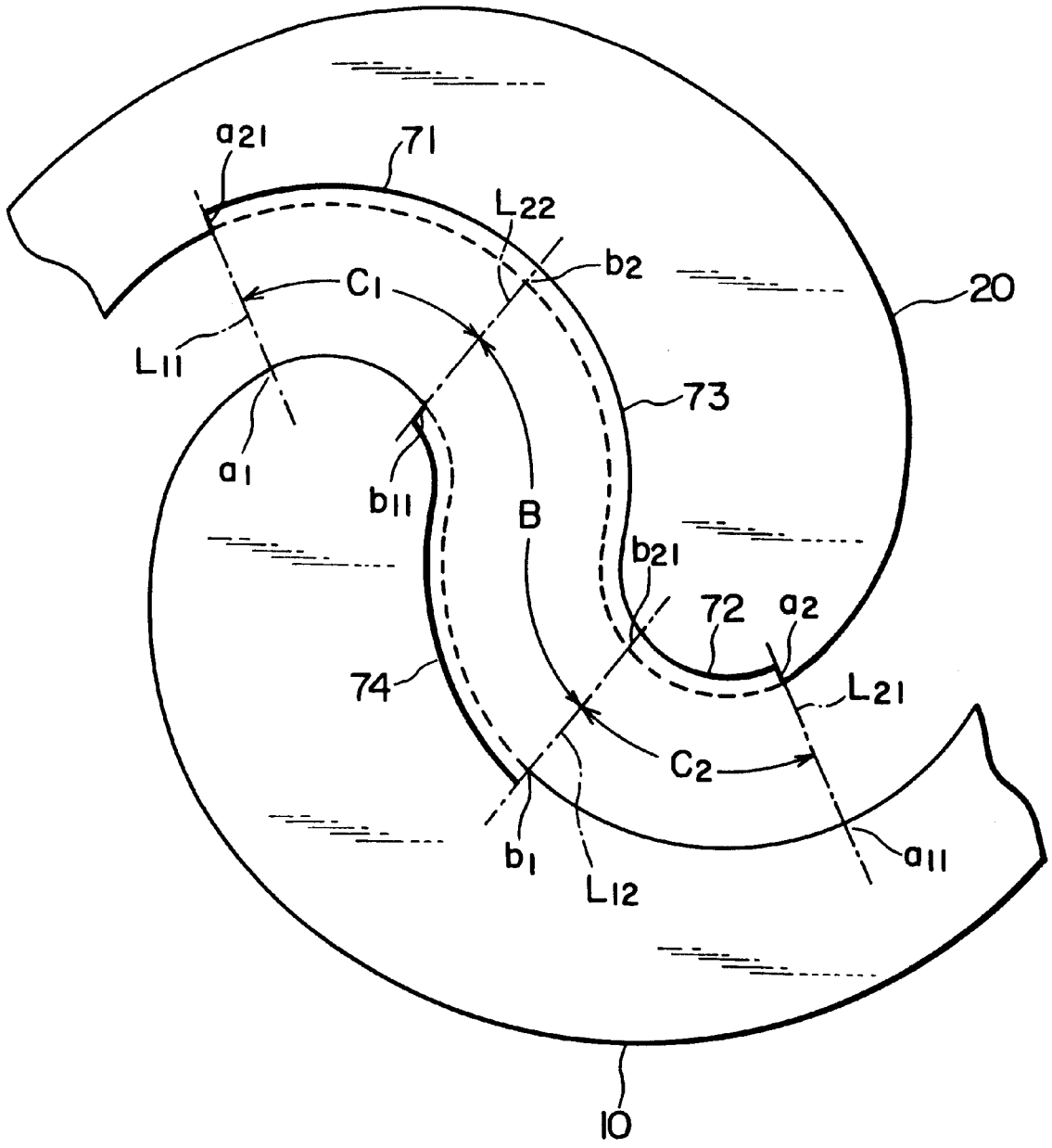
FIG. 4 is a structural schematic view showing a central end part of spiral members according to a fourth embodiment of the present invention.

FIG. 4 shows a fourth embodiment in which the cutaway is formed only in the spiral member 20 for defining the first relief, and the cutaways for defining the second reliefs are distributed in the spiral member 10 and in the spiral member 20.

In FIG. 4, reference numerals 71 and 72 denote cutaway portions for defining the first relief, formed between the points a21 and b2 on the inner wall and between the points b21 and a2 on the inner wall of the spiral member 20. Also, the cutaway amount is the same as that of the cutaway portions 61 and 62 of the above-described third embodiment.

Numerals 73 and 74 denote cutaway portions for defining the second relief, which are formed between the points b2 and b21 on the inner wall of the spiral member 20 and between the points b11 and b1 on the inner wall of the spiral member 10. The cutaway amount therefor is the same as that of the above-described cutaway portions 71 and 72. Accordingly, the cutaway portions 71 and 72 for defining the first relief and the cutaway portion 73 for defining the second relief are formed in series with each other.

Accordingly, in case of this embodiment, the shape of the involute for the spiral member 20 is simplified, and the manufacture thereof is facilitated. Also, since there is no stepped portion between the cutaway portions 71 and 72 for defining the first relief and the cutaway portion 73 for defining the second relief, the mechanical strength of the spiral member 20 is enhanced. Additionally, since the cutaway amounts of the cutaway portions 73 and 74 for defining the second relief are dispersed between the two spiral members, reductions in mechanical strength of the spiral members is avoided.

Further, even if the provision of these cutaway portions is symmetrically reversed between the spiral members 10 and 20, it is possible to ensure the same effect.

Figure 5:
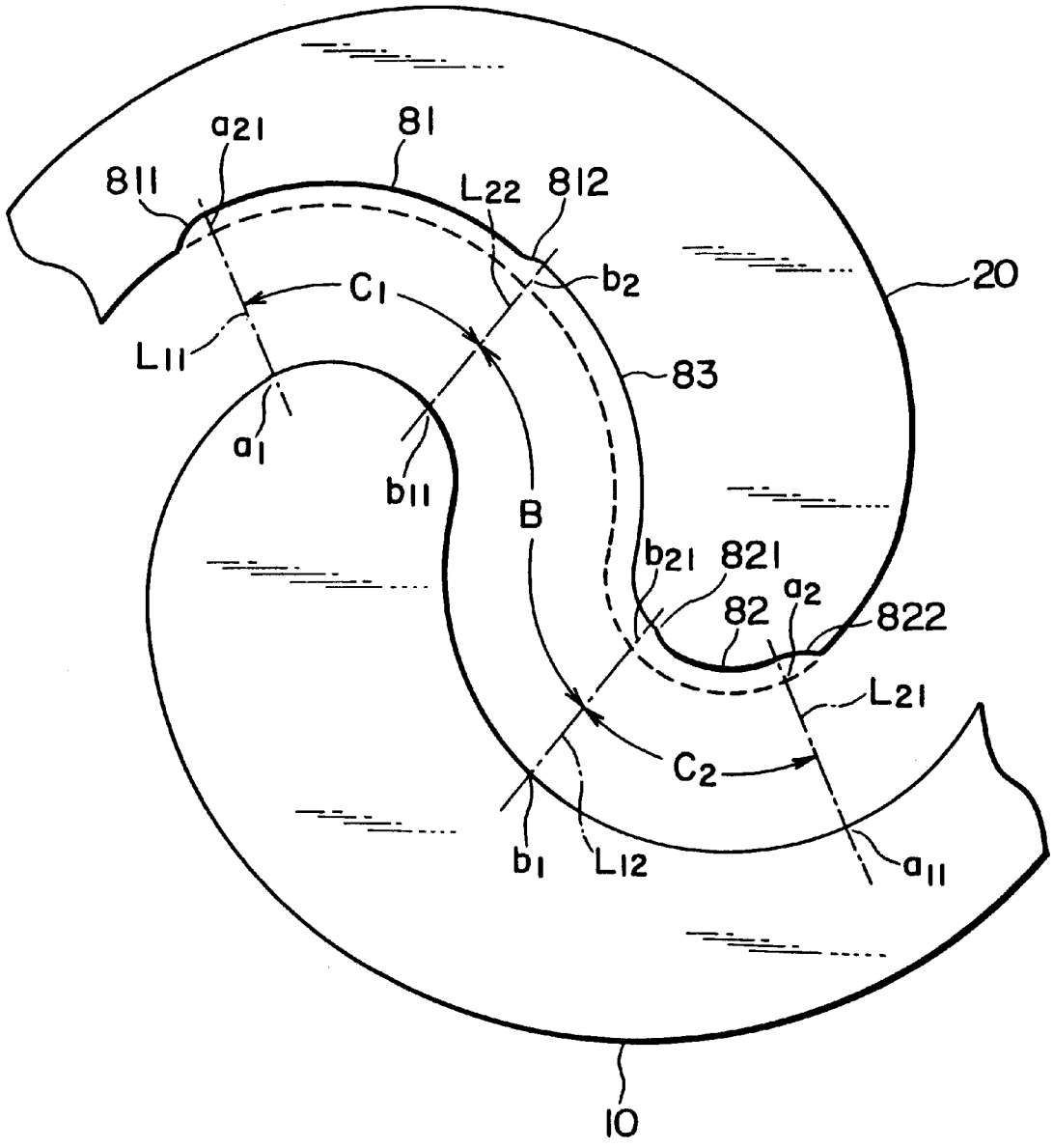
FIG. 5 is a structural schematic view showing a central end part of spiral members according to a fifth embodiment of the present invention.
Figure 6:
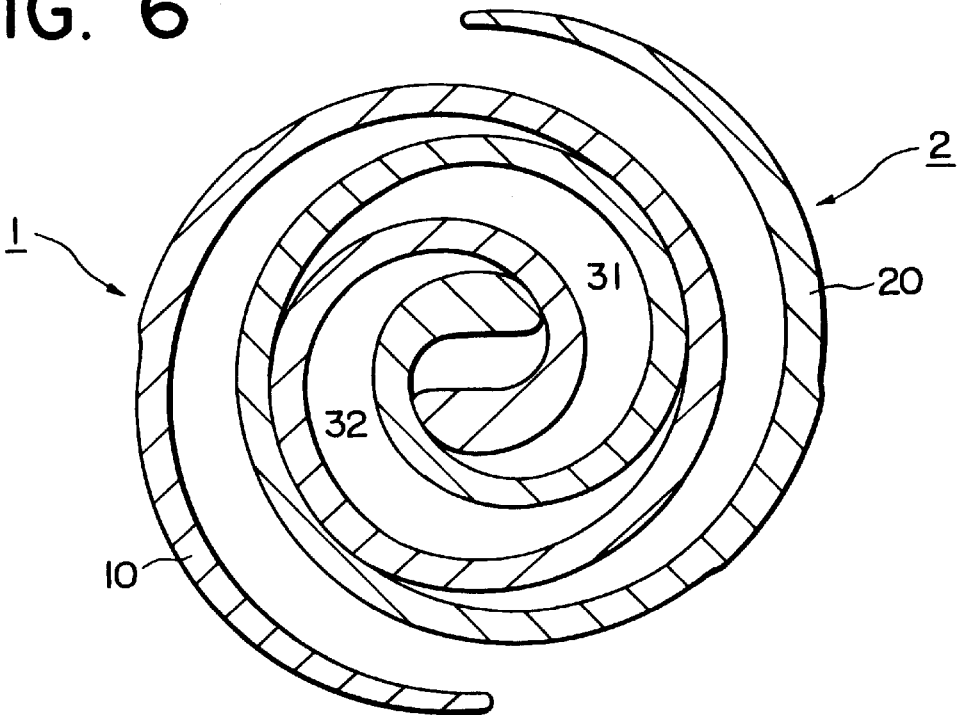
FIG. 6 is a structural schematic view showing scroll bodies in a conventional general scroll type compressor.
Figure 7:
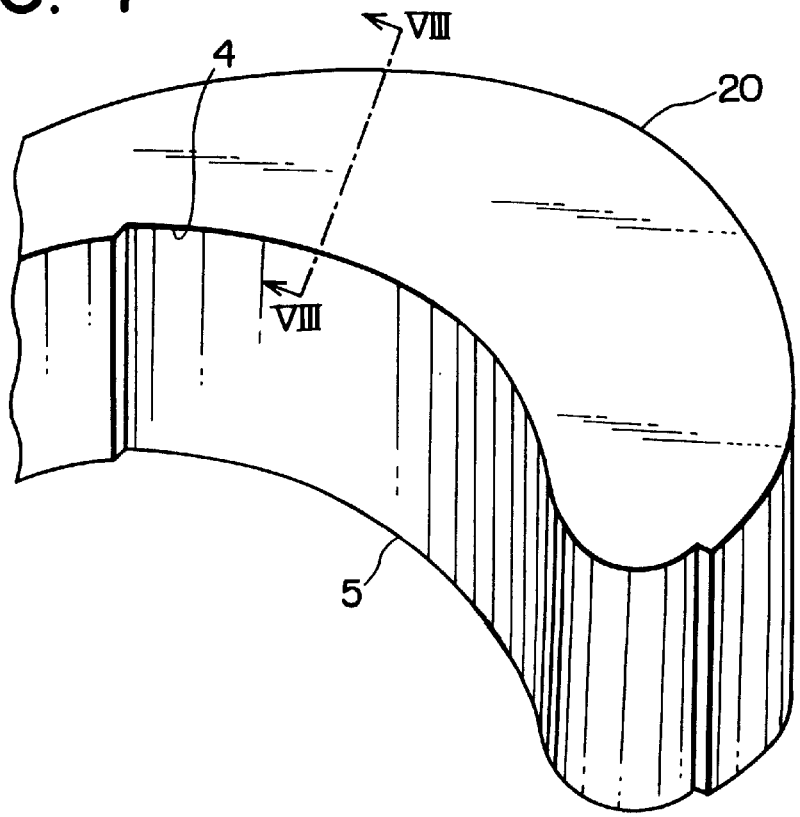
FIG. 7 is a perspective view of a central end part of the scroll bodies shown in FIG. 6.
Figure 8:
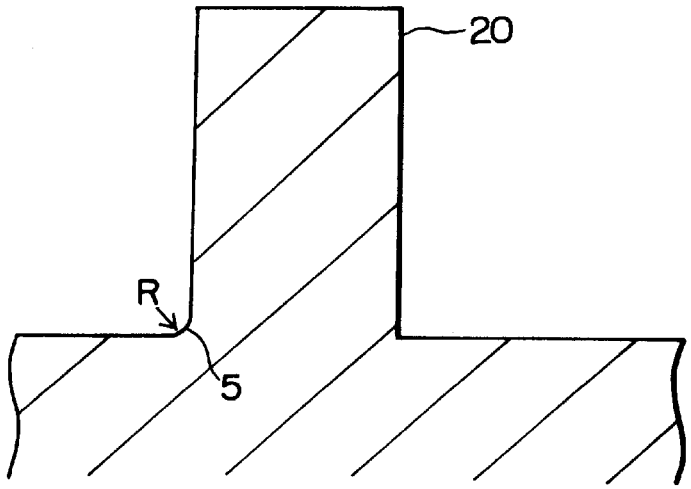
FIG. 8 is a cross-sectional view taken along the line VIII—VIII of FIG. 7.
Figure 9:
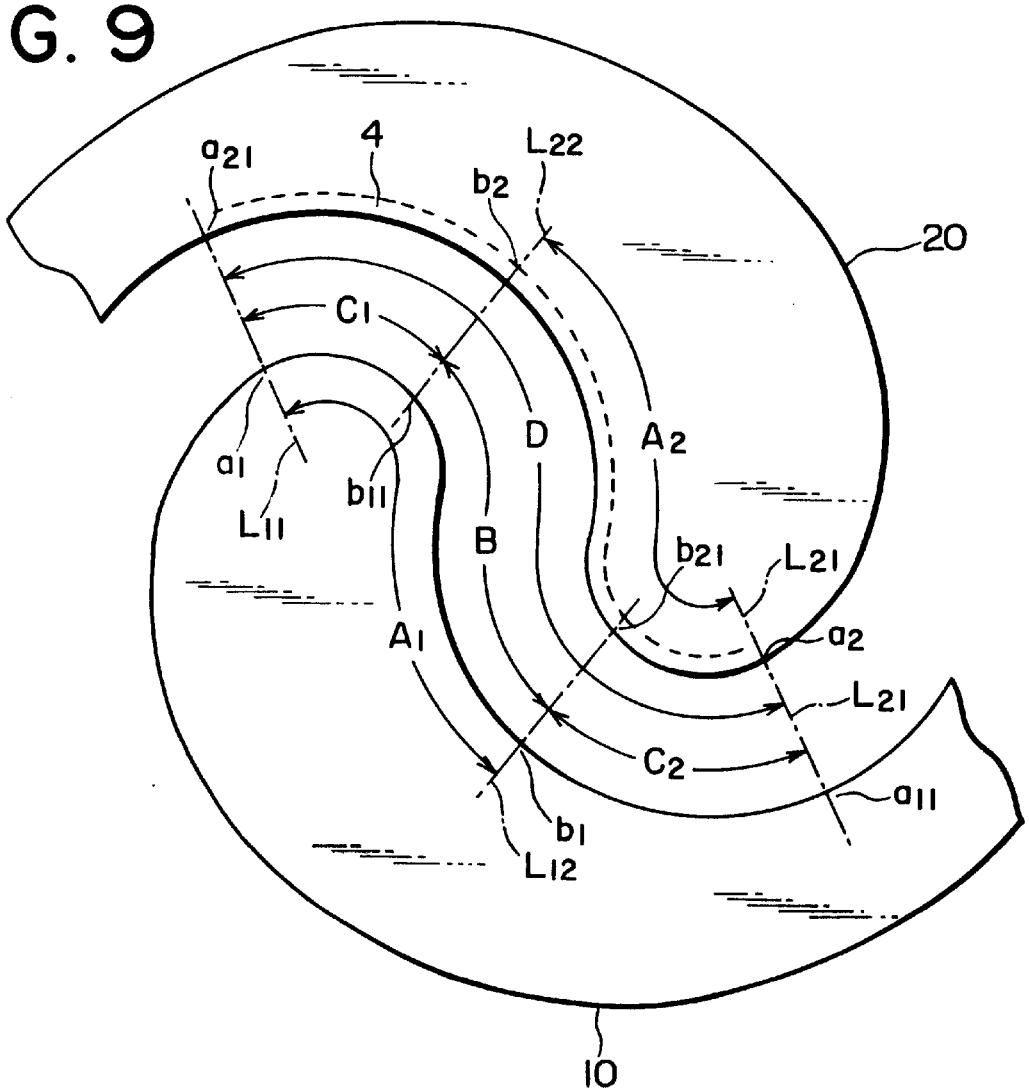
FIG. 9 is a structural schematic view showing a central end part of spiral members of a conventional scroll type compressor.

FIG. 5 shows a fifth embodiment in which ends of the respective cutaways in accordance with the third embodiment are connected with each other and in the inner wall via smooth curved lines. Namely, the cutaway portions 81 and 82 for defining the first relief correspond to the cutaway portions 61 and 62 of FIG. 3, and the cutaway portion 83 defining the second relief corresponds to the cutaway portion 63 of FIG. 3. Then, the ends of the respective cutaway portions 81 to 83 are connected to each other and in the inner wall via small curved lines 811, 812, 821 and 822 in a smooth manner. Accordingly, the concentration of stress affecting each end of the respective cutaway portions 81 to 83 is reduced and the mechanical strength of the spiral member 20 is enhanced.

Further, it is also possible to adopt a symmetrically reverse arrangement between the spiral members 10 and 20 to ensure the same effect.

According to the first through fifth aspects of the present invention, the excessive relief that the conventional system encounters may be avoided, and a reasonable relief is obtained between the two spiral members. Accordingly, it is possible to enhance the performance of the compressor. Also, the durability of the spiral members is enhanced.

According to the second aspect of the present invention, in addition to the effect described above, since the cutaways formed in the two spiral members define the above first and second reliefs, it is possible to reduce the cutaway amount for each spiral member and to enhance the durability of the spiral members.

According to the third aspect of the present invention, since the first relief is machined in one of the spiral members and the second relief is machined in the other spiral member, the cutaways are dispersed between both the spiral members to thereby enhance the durability of the spiral members, and at the same time, the involutes for each of the spiral members are changed in a two-step manner. This makes it possible to readily machine the spiral members.

According to the fourth aspect of the present invention, since the first and second reliefs are formed only in one of the spiral members, it is unnecessary to change the involutes of the other spiral member in a stepped manner, it is easier to machine the spiral members.

According to the fifth aspect of the present invention, since the ends of the cutaways for defining the first and second reliefs are connected to each other via smooth lines, it is possible to avoid stress concentration on the end part edges of the cutaways and to further enhance the durability of the spiral member.

Various details of the invention may be changed without departing from its spirit or its scope. Furthermore, the foregoing description of the embodiments according to the present invention is provided for the purpose of illustration only, and not for the purpose of limiting the invention as defined by the appended claims and their equivalents.

What is claimed is:

1. A scroll type compressor in which two scroll bodies having a spiral member are engaged with each other for moving in circular orbital motion while contacting each other and in which a reinforced portion is provided in a root corner portion of an inner end portion of both of said spiral members where large stress is generated, said root corner portion of the inner end portion being more reinforced than other root corner portions of said spiral members, wherein a first relief and a second relief are provided in regions formed by contact between the inner end portions of said spiral members, the first relief provided where said reinforced portion is present in only one of said spiral members and the second relief provided where said reinforced portion is present in both of said spiral members, wherein the second relief is larger than the first relief.

2. The scroll type compressor according to claim 1, wherein said first and second reliefs are respectively formed of cutaways formed in both spiral members.

3. The scroll type compressor according to claim 1, wherein said first relief is composed of a cutaway formed in one of said spiral members, and said second relief is formed of a cutaway portion formed in the other spiral member.

4. The scroll type compressor according to claim 1, wherein said first and second reliefs are formed of a cutaway formed only in one of said spiral members.

5. The scroll type compressor according to claim 1, wherein ends of said first and second reliefs are formed of lines that continuously change without any stepped connection.

6. The scroll type compressor according to claim 1, wherein the reinforced portion provided in at least one root corner portion is curved.

7. The scroll type compressor according to claim 1, wherein the inner end portion of said spiral members is larger than the rest of the spiral member.

8. The scroll type compressor according to claim 1, wherein the reinforced portion provided in a root corner portion where the inner wall meets the plate member is curved.

9. A scroll type compressor comprising:

first and second scroll bodies, at least one of said scroll bodies moving in a circular orbital motion while coming into contact with the other scroll body, each of said scroll bodies including:

a plate member; and a spiral member outerwardly projecting from the plate member, each of said spiral members including an inner end portion, an inner wall and root corner portions providing reinforced portions where the inner wall projects from the plate member, the reinforced portion provided in the root corner portion where the inner wall of the inner end portion meets the plate member, where large stress is generated, being more reinforced than other root corner portions, wherein a first relief and a second relief are provided in the inner walls in regions formed by contact between the inner end portions of said spiral members, the first relief provided where said reinforced portion is present in only one of said spiral members and the second relief provided where said reinforced portion is present in both of said spiral members, wherein the second relief is larger than the first relief.

* * * * *